United States Patent [19]

Parsons

[11] Patent Number: 5,077,646

[45] Date of Patent: Dec. 31, 1991

[54] ORNAMENTAL LIGHTING FRAME

[76] Inventor: Robert E. Parsons, Four Salem St., North Reading, Mass. 01864

[21] Appl. No.: 605,668

[22] Filed: Oct. 29, 1990

[51] Int. Cl.[5] ..... F21P 1/00

[52] U.S. Cl. ..... 362/252; 362/121; 362/396; 248/74.2

[58] Field of Search ..... 362/121, 252, 806, 807, 362/238, 396, 249; 248/65, 74.2; 40/550

[56] References Cited

U.S. PATENT DOCUMENTS

| | | | |
|---|---|---|---|
| 1,792,676 | 2/1931 | Christastie | 362/121 |
| 1,812,378 | 6/1931 | Scandura | 362/121 |
| 2,722,317 | 11/1955 | Goodwin | 362/807 X |
| 2,894,345 | 7/1959 | Bushnell | 362/121 |

*Primary Examiner*—Stephen F. Husar

*Attorney, Agent, or Firm*—Iandiorio & Dingman

[57] ABSTRACT

An ornamental lighting frame device for the quick and easy shaping of a lighting set having a number of electric lights joined by electric wire, the device including a preshaped frame with a number of openings therethrough and a cantilevered retainer proximate to and extending across the openings to support the electrical wire to provide for the quick and easy placement of the electric lights in a configuration approximating the shape of the frame.

12 Claims, 1 Drawing Sheet

ORNAMENTAL LIGHTING FRAME

FIELD OF THE INVENTION

The preseint invention relates to lighted ornaments and more particularly pre-shaped frames on which to place decorative light sets.

PRIOR ART

At residences during holidays and particularly Christmas Season, lighting displays are erected. In the past most electric light sets have been strung primarily outdoors on trees or roof, window and wall edges. While many ornaments exist, no devices are known, however, for enabling anyone to quickly use currently owned or readily available light sets for diverse and precise shape or symbol creations.

SUMMARY OF INVENTION

The principal object of the invention is to improve and speed up annual creation of lighting displays. These frames will be simply and inexpensively manufactured into recognizable shapes. They will be light weight for easy hanging. They will be durable for outdoor or indoor use. They will accept most of the currently manufactured light sets. With minimum effort the user will be able to install or remove the light sets. The lighting will be retained so as to secure it for rough weather. The lighting will be retained at the edges of the frame. The resulting effect will be placement of consecutive lights in the shape of the frame.

BRIEF DISCRIPTION OF DRAWINGS

FIG. (1) is a front elevation of an ornamental lighting frame in accordance with the present invention.

FIG. (2) is an enlarged fragmentary perspective of a clip retaining lighting.

DETAILED DESCRIPTION

Figure 1:
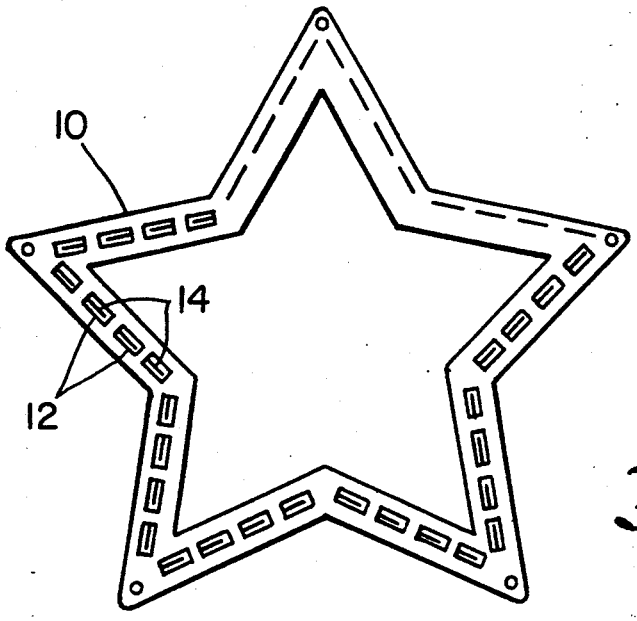
Figure 2:
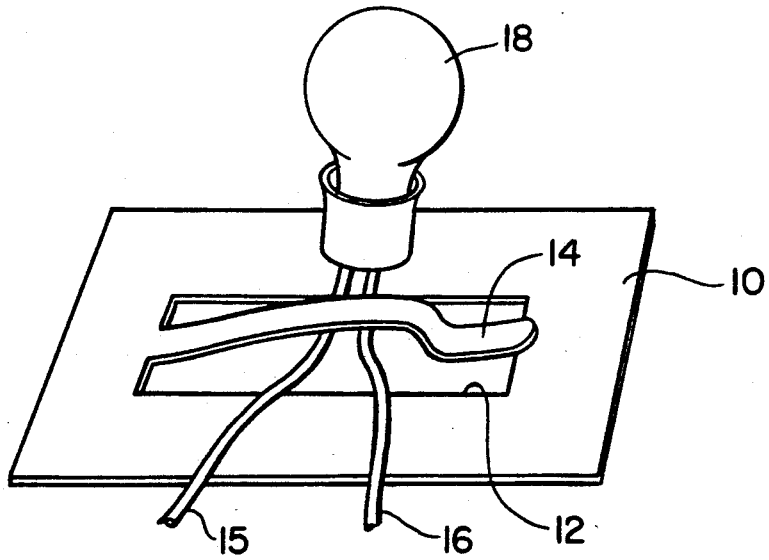

As shown in the drawings the preferred ornamental lighting frame device in accordance with the present invention will likely be constructed of strong molded plastic material. (FIG. 1) The pre-shaped frame 10 will have a series of cut outs 12 with built in clips 14 arranged parallel to its perimenter edges. (FIG. 2) The cut outs will have a molded integral clip 14. The purpose of the clip and cut out will be to retain the electric wire 15,16 thereby aligning the light bulbs 18 parallel to the perimeter edges of the pre-shaped frame 10. The resulting effect will be placement of consecutive lights in the shape of the frame. In use the individual creating shapes while displaying light sets will be able to quickly clip them on to create the shape. The anchoring holes will allow that person to easily hang the ornament on homes or secure them in trees and shrubs. Once light sets are installed they can easily be unclipped and removed or left on for storage until next use. Alternative embodiments would include many seasonal and Christmas shapes and symbols, such as bells, reindeer, candles, Santa Claus and the letters of the alphabet. The forgoing description of the preferred embodiment of the invention has been presented for the purposes of illustration and description. It is not intended that the scope of the invention be limited not by this detailed description but rather by the claims appended hereto.

What is claimed is:

1. An ornamental lighting frame device for the quick and easy shaping of a lighting set having a plurality of electric lights joined by electrical wire, comprising:

a pre-shaped frame, having a plurality of openings therethrough; and at least one cantilevered retaining means, said retaining means proximate to and extending across at least one of said openings, whereby the electrical wire is supported by said retaining means, to provide for the quick and easy placement of the electric lights in a configuration approximating the shape of said frame.

2. The lighting frame device of claim 1, wherein said retaining means further comprises a resilient material.

3. The lighting frame device of claim 1, wherein said retaining means is integral with said frame.

4. The lighting frame device of claim 3 wherein said frame comprises a molded plastic material.

5. The lighting frame device of claim 1, wherein at least one said opening is essentially rectangular in shape.

6. The lighting frame device of claim 5, wherein each of said rectangular openings is parallel to the proximate edge of said frame.

7. The lighting frame device of claim 1, wherein the length of said retaining means is greater than the maximum width of said proximate opening.

8. An ornamental lighting frame device, for the quick and easy shaping of a lighting set having a plurality of electrical lights joined by electrical wire, comprising:

a pre-shape frame comprising molded plastic material and having a plurality of rectangular openings therethrough, each said opening being lengthwise parallel to the proximate edge of said frame; and a plurality of resilient, cantilevered retaining proximate to means and extending across said rectangular openings whereby the electrical wire is supported by said retaining means, to provide for the quick and easy placement of the electrical lights in a configuration approximating the shape of said frame.

9. The ornamental lighting frame device of claim 8, wherein said retaining means are integral with said frame.

10. The ornamental lighting frame device of claim 8, wherein the length of each said retaining means is greater than the length of each said proximate openings.

11. The ornamental lighting frame device of claim 8, wherein said frame further comprises anchoring means to provide hanging support for said device.

12. The ornamental lighting frame device of claim 11, wherein said anchoring means comprises at least one round hole.

* * * * *